United States Patent [19]

Johnson

[11] Patent Number: 5,074,561

[45] Date of Patent: Dec. 24, 1991

[54] PUZZLE

[76] Inventor: Harvey P. Johnson, 9673 Lower Valley Pike, Medway, Ohio 45341

[21] Appl. No.: 570,273

[22] Filed: Aug. 20, 1990

Related U.S. Application Data

[63] Continuation-in-part of Ser. No. 295,305, Jan. 1, 1989, Pat. No. 4,949,969, which is a continuation-in-part of Ser. No. 235,517, Aug. 24, 1988, abandoned.

[51] Int. Cl.[5] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 4,373,729 | 2/1983 | Hanson et al. | 273/153 S |
| 4,949,969 | 8/1990 | Johnson | 273/153 S |

FOREIGN PATENT DOCUMENTS

| | | | |
|---|---|---|---|
| 1199351 | 1/1986 | Canada | 273/153 S |
| 0048795 | 4/1982 | European Pat. Off. | 273/153 S |
| WO82/00101 | 1/1982 | PCT Int'l Appl. | 273/153 S |
| 1319888 | 6/1987 | U.S.S.R. | 273/153 S |
| 2107997 | 5/1983 | United Kingdom | 273/153 S |

OTHER PUBLICATIONS

"Puzzles Old & New" by J. Slocum & J. Botermans, copyright 1986, Dist. by Univ. of Washington Press, Seattle, Wash., p. 138.

*Primary Examiner*—Edward M. Coven
*Assistant Examiner*—Raleigh W. Chiu
*Attorney, Agent, or Firm*—Dykema Gossett

[57] ABSTRACT

A self-contained puzzle has a plurality of slide elements having faces displaying indicia. The elements form a mosaic geometric surface characterized by the absence of one of the elements leaving a slot. A slide element adjacent the slot may be slid into the slot, leaving behind a slot in the position from which the slide element was slid. Rotation of a row adjacent the row containing the slot will bring a new slide element adjacent the slot to be slid thereinto. Accordingly, the plurality of slide elements may be manipulated about so as to juxtapose indicia to bring about an overall composition that is a solution to the puzzle. One embodiment has a solution that is frustum shaped.

12 Claims, 4 Drawing Sheets

PUZZLE

REFERENCE TO EARLIER APPLICATION

The present application is a continuation-in-part of a copending application, Ser. No. 295,305 filed Jan. 1, 1989, U.S. Pat. No. 4,949,969, which in turn was a continuation-in-part of a then copending application, Ser. No. 235,517 filed Aug. 24, 1988 and entitled "PUZZLE", now abandoned.

FIELD OF THE INVENTION

The present invention relates to puzzles and puzzle games. More particularly, the present invention relates to three-dimensional puzzles that include a plurality of interconnected members, each member carrying indicia which relates in certain fashion to indicia carried by another and each member capable of being manipulated into juxtaposition with another so that the relationship between indicia may be used to form a correct solution. The present invention also relates to amusement devices, more particularly puzzles, used as vehicles for advertising.

BACKGROUND OF THE INVENTION

Many kinds of three-dimensional puzzles are in existence for the purpose of providing amusement with varying degrees of challenge. Particular types of puzzles, those most related to the invention herein disclosed, are characterized by movable parts carrying indicia that are placed into juxtaposition with one another so that the indicia form a puzzle solution. Solutions range from those that result from such simple operations as aligning color indicia into rows or columns to solutions in the form of graphic representations arrived at by having each movable part in a predetermine position with respect to all other movable parts, for example, a solution requiring sequential positioning of numeral indicia or an overall pictorial representation with each part carrying a small portion of the picture. A picture may form a promotional representation or advertisement. Such a range provides for amusement for a range of operators, from young children to adults.

Such puzzles as have been described have certain advantages over other types of puzzles. For one, puzzles formed of interconnected parts assure that all parts will be available to the operator in forming a solution, as contrasted with traditional puzzles where parts may be lost so as not to be available in forming a solution. Related to this advantage is the advantage of being transportable as a unit. Without parts that may be lost from one another, such puzzles are available to provide amusement on long automobile trips, particularly for youthful passengers confined to the back seat of the automobile.

PRIOR ART

Perhaps one of the most popular three-dimensional puzzle-type games with interlocking parts in the "Rubik's Cube." This type of puzzle is in the form of a cube that is made up of a multiplicity of elements which make up the facial sides of the cube and appear to be smaller cubes. Two human hands grasping the overall cube with palms facing each other can be used to twist subsections of the cube, which are made up of the multiplicity of elements, away from each other so that one subsection that had been part of one side of the cube can be oriented to be a part of another side of the cube. The twisting can take place with regard to each side of the cube so as to manipulate elements into different relative positions with respect to one another. In this manner, colors can be aligned in a multiplicity of colored elements, or graphic indicia may be so aligned.

Because of the degrees of freedom presented by the twistable mechanism of the Rubik's Cube, manipulation into indicia alignment is a relatively complex intellectual operation. Accordingly, the Rubik's Cube is much more adapted to age groups having a developed sense of spatial relations. At the same time, the twisting mechanisms of the Rubik's Cube serve to develop only one dimension of manipulative skill, that of twisting into alignment. As such, the forecasting ability of moving from one spatial relationship into another, gets adequate exercise, but there is little activity in the realm of eye-hand coordination in aligning various elements of the puzzle.

U.S. Pat. No. 4,651,992, issued to Danino et al., discloses a puzzle-type game in which five manipulatable members may be rotated about a common axis so as to be placed in any desired angle with respect to one another. Each of the members may have painted on its outer faces, opposite the axis of rotation, indicia representing one element of multi-element relationships produced by aligning the angles of the various rotatable members relative to one another. The indicia may be also positioned axially, but this calls for taking apart the various elements so as to put them in a different axial relationship. As a result, parts of this may be lost when the elements are taken apart.

U.S. Pat. No. 4,632,399, issued to Bern, discloses a manipulative puzzle formed of a succession of coaxial wheel-like elements in somewhat similar relationship to the elements of the Danino et al. puzzle. In a way similar to the Danino et al. puzzle, the Bern puzzle requires separating parts from the puzzle in order to move parts axially with respect to one another. Accordingly, the Bern puzzle suffers from the same shortcoming of the Danino et al. device, that is, parts may be easily lost so as to frustrate the self-contained basis of the puzzle.

U.S. Pat. No. 4,445,691, issued to Stark et al., discloses a method for forming a puzzle that involves cutting a sheet on which there is a design into a plurality of parallel strips, cutting some or all of the strips transversely to form multiple pieces, rearranging the pieces of each cut strip end-for-end to form secondary strips, forming each of the strips into an endless ring, and assembling the rings on a spindle for independent rotation about a common axis. Relative rotation of the rings will enable the segments or portions of the design on each ring to be aligned or registered in such a manner as to reproduce and display the original design. This puzzle is a very simple puzzle and should not hold the attention of an operator who is above the age of a toddler. Moreover, this puzzle does not provide for transaxial positioning of the various segments of the rings.

OBJECTS OF THE INVENTION

Accordingly, it is one object of the present invention to provide a puzzle having interconnected parts so that individual parts will not be lost and thereby become unavailable for use with other parts.

It is another object of the present invention to provide a puzzle that presents a range of challenges so as to provide entertainment for adults and children alike.

It is yet another object of the present invention to provide a puzzle that develops skills in predicting spatial relationships and develops manipulative skills.

It is yet still another object of the present invention to provide a puzzle that entertains by providing a range of challenges in manipulating indicia to effect a solution to the puzzle, and, by so entertaining, draws attention to indicia which may be used as a vehicle for advertising.

Still yet another object of the present invention is to provide a series of puzzles that has a range of shapes aligned about a cylindrical base.

SUMMARY OF THE INVENTION

According to the invention, a self-contained puzzle is in the configuration of a cylinder having a cylindrical surface and a central axis. The puzzle has a plurality of slide elements disposed longitudinally in rows that are each disposed concentrically about the central axis. Faces on the slide elements display indicia. Each slide element is retained by a base structure that keeps the face of the slide element in registry with the cylindrical surface. The base structure also restricts the slide element so that it is only capable of being slidably transpositioned, relative to other slide elements, in a direction parallel to the central axis, from one row into another.

The faces of the slide elements form a mosaic, geometric surface characterized by the absence of one of the slide elements, so as to leave a slot into which an adjacent slide element may be slid to transposition it relative to the other slide elements. When the adjacent slide element is slid into the slot, it leaves a slot in the position from which it was slid.

The base structure indicates a multiplicity of rotatable base wheels aligned end-to-end concentrically about an axle which extends along the central axis. The base wheels are rotatable about the axle, which includes one part of a detent mechanism that is cooperative with another part to temporarily hold each rotatable base wheel structure in a relative angular disposition with respect to another rotatable base wheel structure.

At least one end rotatable base wheel is disposed at each end of the aligned multiplicity of rotatable base wheels. Each end rotatable base wheel has at least one female fitting that opens toward the end at which the end rotatable wheel is disposed. An end cap, having a male fitting, is received onto the end rotatable base wheel.

Each base wheel includes a cylindrical hub collar of determinable length. The hub collar has a hub inner surface that faces radially inwardly. A plurality of detent grooves are disposed in the hub collar parallel to and spaced concentrically about the central axis and the axle. The hub collar has an outer surface from which a plurality of planar spokes radiate. An outer collar is disposed concentrically about the hub collar and has a surface which faces radially inwardly to receive the plurality of planar spokes.

In a radially outwardly-facing surface of the outer collar are a plurality of mortise grooves disposed parallel to and concentrically about the central axis and the axle. Each slide element has a dovetail tenon that projects radially inwardly toward the central axis to be inserted into and retained by one of the mortise grooves in one of the outer collars, such that the slide element with its dovetail tenon is slidable along one of the mortise grooves of one outer collar to the mortise groove of another outer collar when the mortise grooves of the two collars are aligned.

As the base wheels are rotatable, rotation of a row adjacent the row containing the slot will bring a new slide element adjacent the slot to be slid thereinto. Accordingly, the puzzle may be manipulated to change angular or rotational alignments of the slide elements on one base wheel with respect to the slide elements on another and manipulated to slide a slide element into the slot at one position to fill the position with a particular slide element or to open a slot in the position formerly occupied by the particular slide element, so that the new slot might be filled with another particular slide element. Changing axial alignments of the slide elements with respect to another can be used to position the indicia on the faces of the slide elements so that an arrangement of indicia may be effected as a solution for the puzzle.

In one embodiment, a solution is in the form of a popular beverage can, the arrangement of indicia effecting an image of the trade dress of the beverage. According to this embodiment, the amusement brought to the operator has commercial advertising value to the marketer of the beverage. In another embodiment, the solution is in the form of a milk shake cup that is a mosaic of slide elements. Thus, the puzzle has a solution in the shape of a frustum, while the base of the puzzle from which slide elements depend is in the shape of a cylinder.

BRIEF DESCRIPTION OF THE DRAWINGS

The invention that is to be herein described by way of example only, will be described with reference to the accompanying drawings wherein.

BRIEF DESCRIPTION OF THE PREFERRED EMBODIMENT

Figure 1:
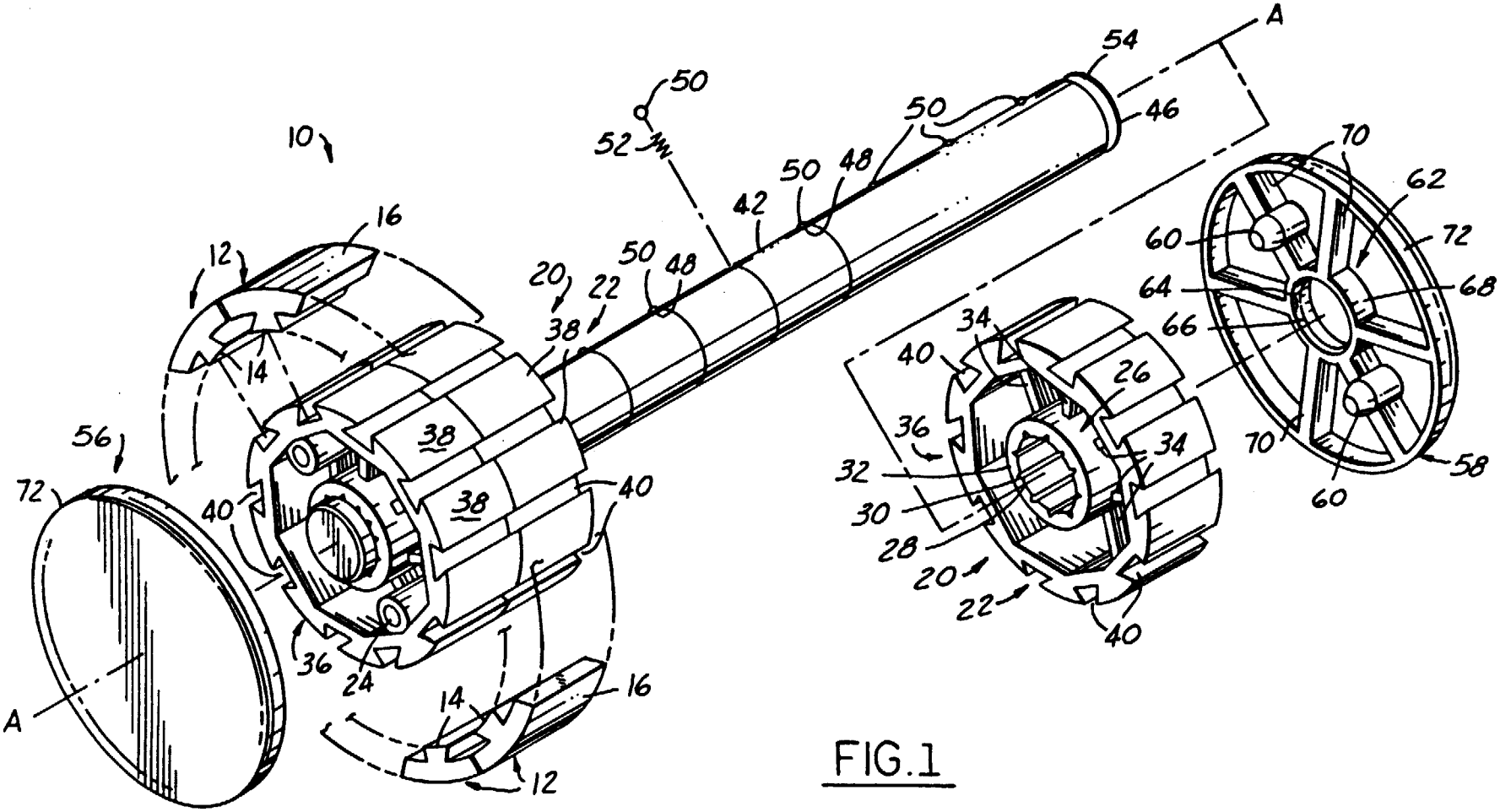
FIG. 1 is an exploded partial isometric of the puzzle.

To introduce the overall structure of the present invention, reference will first be made to FIGS. 1 and 2. In these figures, a self-contained cylindrical puzzle is generally indicated by reference numeral 10.

The puzzle has a plurality of slide elements 12. As best can be seen in FIG. 1, each slide element 12 has a dovetail tenon 14 which projects radially inwardly to an axis A—A. Each slide element 12 includes a curved face 16 which has indicia on it. The curved face 16 projects radially outwardly from the axis A—A.

The faces 16 of the slide elements 12 form a mosaic cylindrical surface characterized by the absence of one of the slide elements 12 and its face 16. This absence leaves a slot 18 in one position on the cylindrical surface into which one of the plurality of slide elements 12 may be slid. When the one slide element 12 is slid into slot 18, it will leave another slot in the position from which slide element 12 was slid.

Figure 2:
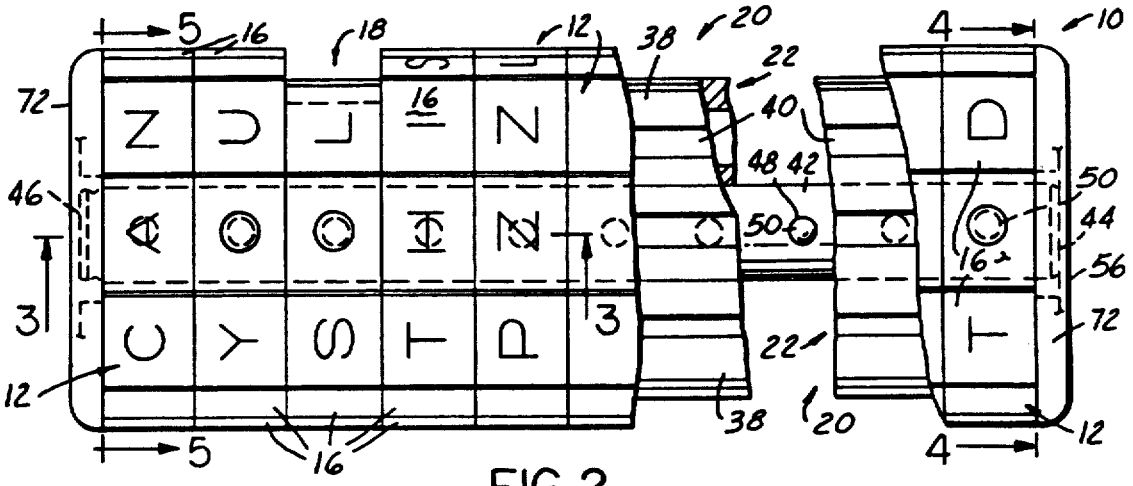
FIG. 2 is a side elevation of the puzzle.
Figure 3:
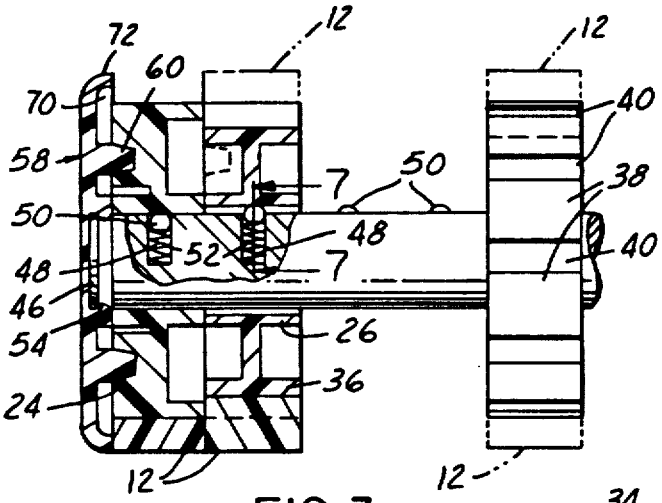
FIG. 3 is a partial sectional view shown in the direction of arrows 3—3 of FIG. 2.
Figure 4:
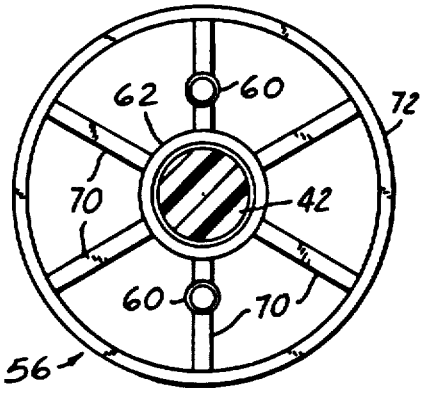
FIG. 4 is an end sectional view of the puzzle taken in the direction of arrows 4—4 of FIG. 2.
Figure 7:
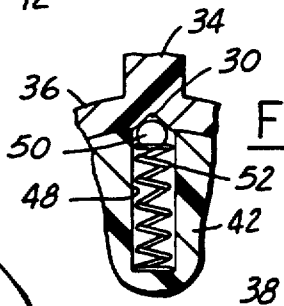
FIG. 7 is a detailed sectional view taken in the direction of arrows 7—7 of FIG. 3.
Figure 5:
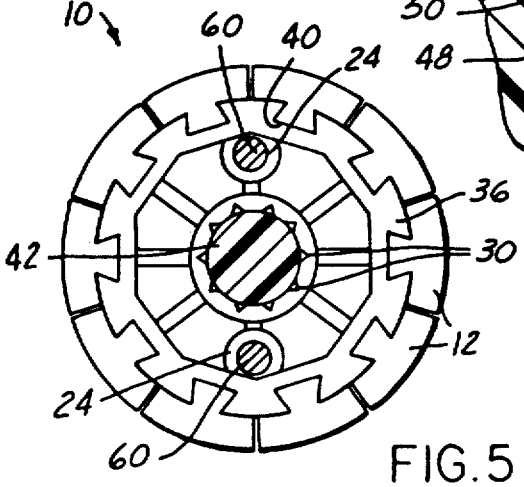
FIG. 5 is an end sectional view of the puzzle taken in the direction of arrows 5—5 of FIG. 2.
Figure 6:
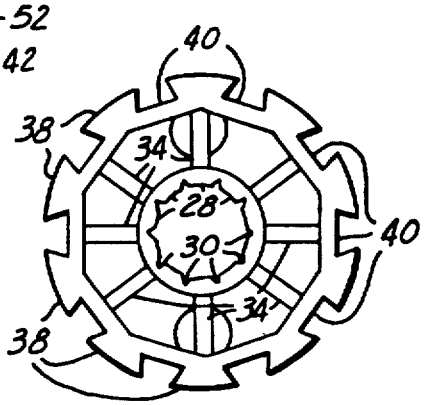
FIG. 6 is an end view of a base structure revealed in FIG. 1.

The particular means by which slide elements 12 may slide into positions left by slots, as for example slot 18 shown in FIG. 2, is afforded by a base structure referred to generally in FIGS. 1 and 6 by reference numeral 20. The base structure 20 keeps the faces 16 of the slide elements 12 in registry as components of the cylindrical surface. The base structure 20 also restricts the slide elements 12 so that a slide element 12 is only capable of sliding in a direction parallel to the central axis A—A into a slot 18, when the slot 18 is availably juxtaposed to the element 12. More particularly, the base structure 20 comprises a multiplicity of rotatable base wheels 22 aligned end-to-end concentrically about the axis A—A. At least one rotatable base wheel 22 is disposed at each end of the aligned multiplicity of base wheels 22 and is accordingly an end rotatable base wheel 22. The end rotatable base wheel 22 is characterized by its having at least one female fitting 24 that opens toward the end of the aligned multiplicity of rotatable base wheels 22. Preferably, for manufacturing convenience, this feature characterizes all of the rotatable base wheels 22, although the feature is relevant only to the end rotatable base wheel 22. Accordingly, rotatable base wheel 22 has at least one male fitting 60 which is insertable into female fitting 24, so that end cap 56 or 58 does not pivot relative to end rotatable base wheel 22.

Each base wheel 22 includes a cylindrical hub collar 26 of determinable length. Hub collar 26 has a hub inner surface 28 which faces radially inwardly and in which a plurality of detent grooves 30 are disposed parallel to and spaced concentrically about axis A—A. Hub collar 26 has an outer surface 32 from which a plurality of planar spokes 34 radiate.

Each base wheel 22 includes an outer collar 36 to which planar spokes 34 radiate. Outer collar 36 is disposed concentrically about hub collar 26, with a surface 38 facing radially outwardly. Surface 38 has a plurality of mortise grooves 40 which are disposed parallel to and concentrically about axis A—A. The dovetail tenon 14 of each slide element 12 is insertable into, retainable by, and slidable along a mortise groove 40 of an outer collar 36. As the dovetail tenon 14 of each slide element 12 is slidable along a mortise grooves 40 of an outer collar 36, it is slidable from a mortise groove 40 of one outer collar 36 to the mortise groove 40 of another, when the mortise groove 40 of one outer collar 36 and the mortise groove 40 of the other are aligned.

An axle 42 has two ends 44 and 46. Axle 42 extends between ends 44 and 46 along axis A—A, through cylindrical hub collars 26 of the multiplicity of rotatable base wheels 22. Base wheels 22 are accordingly, rotatable about axis 42. Axle 42 has detent means comprising a multiplicity of sockets 48 in axle 42, which are spaced discretely from one another, generally by the determinant length of hub collar 26. Sockets 48 are aligned parallel to axis A—A. Each socket 48 receives therein a cammable detent 50 and a means, a spring 52 as shown, biasing the detent 50 radially outwardly. When base wheel 22 is rotated so as to bring the detent groove 30 into alignment with the detent 50, detent 50 is biased into a detent groove 30 in the inner surface 28 of hub collar 26. The detent 50 is cammable out of the detent groove 30. Finally, axle 42 has a retention means on each end 44 and 46 and functions cooperatively with end caps 56 and 58, alignable with a respective female fitting 24 of an end rotatable base wheel 22 and fittable thereinto. Each end cap 56 or 58 includes a cylindrical hub rib 62, which has a hub rib inner surface 64. The hub rib inner surface 64 faces radially inwardly. A concentric retention groove 66 is disposed in the inner surface 64. The retention means of the axle 42, that is, lip 54, is snap-fittable into retention groove 66. Hub rib 62 has an outer surface 68, from which a plurality of spoke ribs 70 radiate. Each end cap 56 or 58 also includes an outer rim 72 to which spoke ribs 70 radiate.

Puzzle 10 is a self-contained unit which may be manipulated by grasping the cylindrical surface at the outer face 16 of the slide elements 12 and rotating a row of slide elements 12 captured in a base wheel 22 relative to a row of slide elements 12 captured in another base wheel 22, so as to change angular or rotational alignments of the slide elements 12 on the one base wheel 22 with respect to the slide elements 12 on the other. By sliding a slide element 12 into the slot 18 at one position, the axial alignments of slide elements 12 with respect to one another are changed. Accordingly, indicia on the faces 16 of the slide elements 12 change their relative positions with respect to one another. A considered manipulation of the slide elements 12, angularly and axially with respect to one another so as to change the relative positions of the faces 16 of the slide elements and the indicia thereon, will cause the indicia on the faces 16 of the slide elements 12 to eventually be positioned so as to represent a solution to the puzzle 10.

Figure 8:
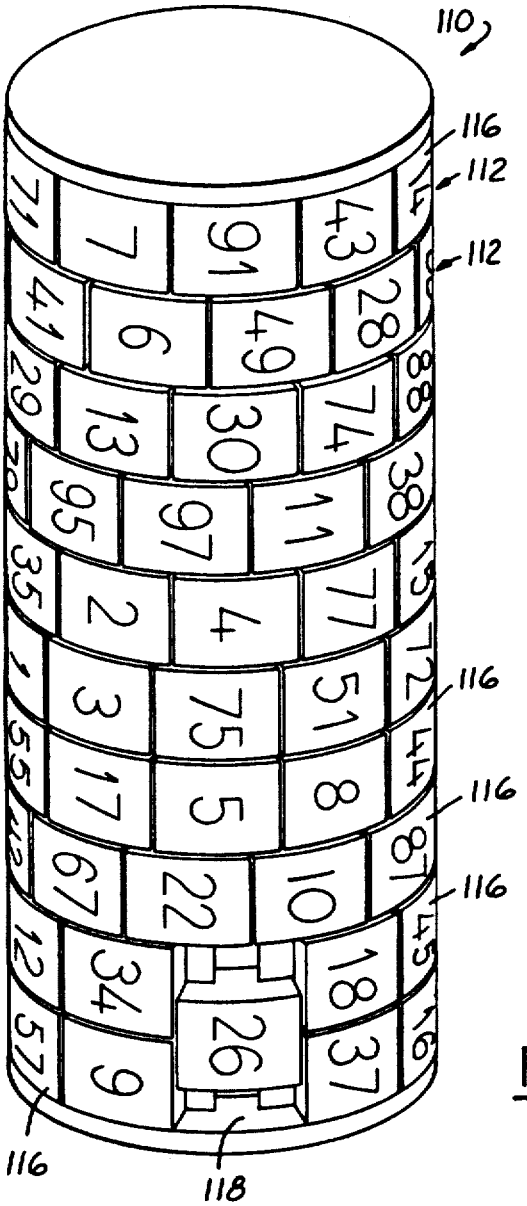
FIG. 8 is a perspective view of an embodiment of the invention which has a surface dress of numerical indicia.
Figure 9:
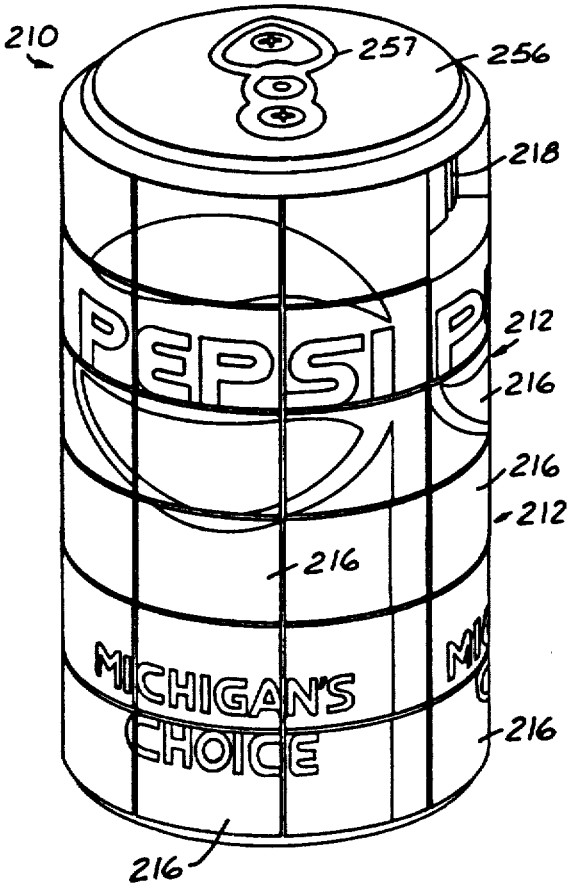
FIG. 9 is a perspective view of an embodiment of the invention which has a surface dress that is the trade dress of a popular beverage.

Referring now to FIGS. 8 and 9, a self-contained puzzle is indicated in FIG. 8 as being generally at 110, and in FIG. 9, as being generally at 210. Either of the puzzles 110 or 210 may be grasped at the outer faces 116 or 216 and each row of puzzles 110 or 210, which contains slide elements 112 or 212, may be rotated to change angular or rotational alignments of the slide elements 112 or 212 captured by a base wheel, like the base wheel 22 in FIG. 1, with respect to slide elements 112 or 212 captured by other base wheels of puzzles 110 or 210. By sliding a slide element 112 or 212 into a slot at one position, here shown as at 118 or 218, the axial alignments of slide elements 112 or 212 with respect to one another are changed. Accordingly, indicia of the faces 116 or 216 of the slide elements 112 or 212 change their relative positions with respect to one another. For puzzles 110 or 210 the considered manipulation of the slide elements 112 or 212, angularly and axially with respect to one another so as to change the relative positions of the faces 116 or 216 of the slide elements 112 or 212 of the indicia thereon, will cause the indicia of the faces 116 or 216 of the slide elements 112 or 212 to eventually be positioned in a solution to the puzzles 110 or 210.

Figure 10:
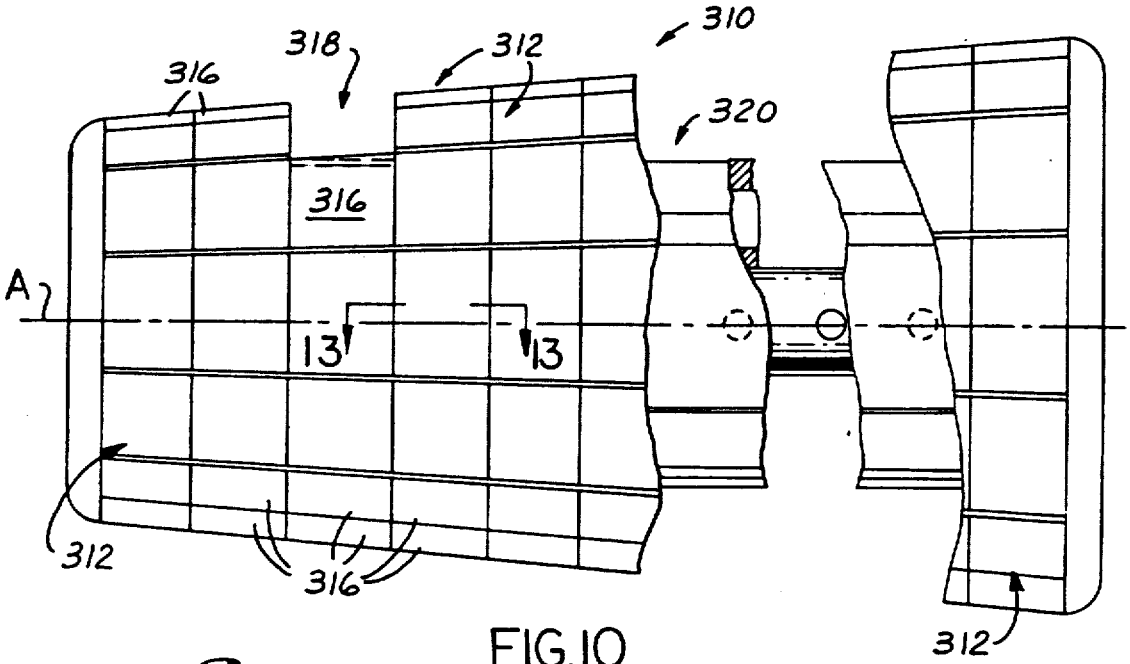
FIG. 10 is a cut-away elevational view of an embodiment of the invention which has an external shape that is different from the cylindrical shape of the puzzles shown in FIGS. 8 and 9.

A particular aspect of the invention can be seen in FIG. 10. In this figure, the self-contained puzzle is generally indicated by reference numeral 310.

The puzzle 310 has a plurality of slide elements 312. Each slide element 312 includes a curved face 316 which has indicia on it. The curved face 316 of each slide element 312 projects radially outwardly from axis A—A.

Figure 13:
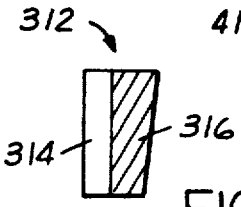
FIG. 13 is a cross-section of a slide element taken in the direction of the arrows 13—13 of FIG. 10.

The particular means by which slide elements 312 may slide into position left by an absence of one of the slide elements is the same as disclosed with regard to the puzzle 10 shown in FIGS. 1-7. The absence or slot 318 receives a slide element 312 adjacent slot 318, leaving another slot 318 into which another slide element 312 may be slid. The base structure 320 of puzzle 310 is likewise the same as the base structure 20 of puzzle 10 in FIG. 2. The essential difference between the embodiment of the puzzle shown in FIG. 10 and the embodiment of the puzzle shown in FIG. 2 is that the slide elements 12 of puzzle 10 are all of uniform cross-section, whereas the slide elements 312 are of varying cross-sections depending on the position of a particular slide element will occupy when all of the slide elements occupy the positions for the puzzle solution. Thus, as can be seen in FIG. 13 a slide element 312 of puzzle 310 has a dovetail tenon 314 like the dovetail tenon of slide element 12 of puzzle 310. The face 316, however, slopes outwardly to effect the frustum shape of puzzle 310.

Figure 11:
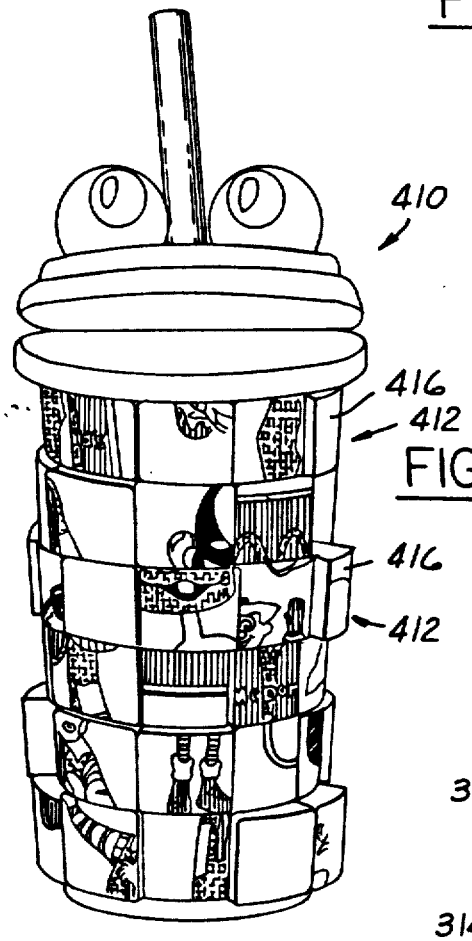
FIG. 11 is a perspective view of an embodiment of the invention, which has a shape and surface dress that is the trade dress of a popular premium when in the configuration of the puzzle's solution, but the view showing the puzzle when not in the configuration of the solution.
Figure 12:
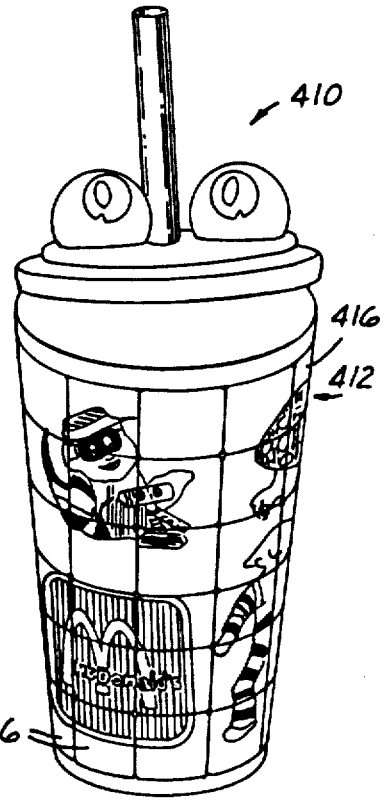
FIG. 12 is a perspective view of the embodiment of the invention of FIG. 11, when the solution to the puzzle has been attained.

The discovery that the base structure of the puzzle does not change with the change of the cross-section of the slide element allows for the puzzle to have a range of shapes for its solution. As an example, FIG. 11 shows a milk shake container 410 that is a premium of a popular fast food chain. As seen in FIG. 11 the puzzle 410, when not in the configuration of the solution to the puzzle, is irregularly shaped with the faces 416 of the slide elements 412 out of registry, as compared with puzzle 10 when its the slide elements 12 are not in the configuration of the solution to the puzzle 10. Nevertheless, when the slide elements 416 of FIG. 11 are in the configuration of the solution to the puzzle, the faces 416 of the slide elements are in registry.

Solutions may be the result of simple operations involving aligning color indicia into rows, each row being an alignment of slide elements 12 concentrically about a base wheel 22, or columns, each column being an axial alignment of slide elememts 12. Solutions may also be graphic representations arrived at by having each slide element 112 in a predetermined position with respect to all other slide elements to effect a sequential positioning of numerical indicia as shown in FIG. 8. An overall pictorial representation with each face 16 carrying a small portion of the picture may also effect a solution. In one particular embodiment, shown in FIG. 9, the indicia, which on each face 216 is a color graphic, may be arranged to display the trade dress of a popular beverage can. To render a realistic illusion of the popular beverage can, the puzzle 210 has at least one end cap 256 that has a three dimensional form or graphic representation of a can top, as for example the tab-top 257 shown in FIG. 9. Such a range of solutions provides amusement for a range of operators, from young children to adults, the amusement draws such attention to the indicia that the puzzle provides a vehicle for displaying promotional indicia.

I claim:

1. A self-contained puzzle having a central axis, the puzzle comprising:

an arrangement of discrete slide elements, some of which are of different thicknesses than others, the arrangement including columns arranged parallel to the central axis and rows intersecting said columns, each row arranged generally to encircle the central axis and being rotatable thereabout, at least one column of said columns including discrete slide elements and including at least one slot being fillable by one slide element of said discrete slide elements, a slide element juxtaposed to said slot being capable of sliding to fill said slot, a plurality of said columns arranged about the central axis with said at least one column so that said columns cooperate to completely encircle the central axis, at least one row including discrete slide elements and including said at least one slot at an intersection of said at least one row and said at least one column, each slide element having at least one face facing generally radially outwardly from the central axis so that all of the faces facing generally radially outwardly from the central axis together form a mosaic geometric surface; and indicia displayed on each at least one face so that all of the at least one faces together are capable of displaying a compositional pattern on said mosaic geometric surface and are capable of displaying a random pattern, depending upon the position in rows and columns of the slide elements with respect to one another, whereby manipulations of the puzzle, by rotating any row of discrete slide elements relative to an adjacent row so as to change the positions of all of the slide elements in said any row has in any column to a position in another column and by sliding a slide element into the slot at one intersection of at least one row and at least one column to change the position of the slide element from one row to another, may be used to position indicia on the faces of the slide elements to represent a solution for the puzzle.

2. The puzzle of claim 1 wherein the compositional pattern that all of the at least one faces together are capable of displaying is an arrangement of numerals in a sequence of numbers.

3. The puzzle of claim 1 wherein the indicia displayed on each at least one face is a color, the color on each at least one face of one slide element being different from the color on each at least one face of at least one other slide element, and wherein the compositional pattern that all of the at least one faces together are capable of displaying is a color pattern.

4. The puzzle of claim 3 wherein the compositional pattern that all of the at least one faces together are capable of displaying is a different color for each row of the puzzle.

5. The puzzle of claim 1 wherein the indicia displayed on each at least one face is a color graphic, the color graphic on generally each at least one face of one slide element being different from the color graphic on each at least one face of at least one other slide element, and wherein the compositional pattern that all of the at least one faces together are capable of displaying the trade dress of a popular beverage can.

6. The puzzle of claim 5 wherein the puzzle is frustum shaped.

7. A puzzle comprising:

axial means for holding component parts of the puzzle in axial alignment;

a plurality of slide elements, some of said slide elements being thicker than others, each slide element having first part holding means for holding said each slide element radially inwardly toward said axial means while allowing said each slide element to slide in a direction parallel to said axial means and each slide element including a face having indicia thereon and projecting radially outwardly from said axial means, all of the faces of the slide elements generally forming together a mosaic geometric surface about said axial means, the surface characterized by the absence of at least one slide element, leaving a first slot into which an axially juxtaposed slide element is slidable to leave a second slot from which said axially juxtaposed slide element would slide to fill said first slot; and a multiplicity of rotatable base structures aligned end to end concentrically about said axial means so that one base structure is axially juxtaposed to another, each base structure having a second part holding means for cooperating with said first part holding means to hold said each slide element radially inwardly toward said axial means while allowing said each slide element to slide from one rotatable base structure to another as said each slide element slides axially into a first slot and out of a second slot, whereby the puzzle may be manipulated by rotating one base structure relative to an axially juxtaposed base structure so as to change axial juxtapositions of slide elements held by said axially juxtaposed base structures thereby changing the juxtapositions of indicia on the faces of said slide elements and putting some of said faces out of and into registry with other of said faces and the puzzle may be manipulated by sliding said axially juxtaposed slide element into said first slot thereby changing the juxtaposition of indicia on the face of said axially juxtaposed slide element with respect to other indicia and the puzzle may be continually manipulated by rotating base structures and sliding elements juxtaposed to slots until the indicia is arranged to represent a solution for the puzzle.

8. The puzzle of claim 7 wherein said axial means includes an axle having two ends, the axle extending between said two ends through said rotatable base structures so that said base structures are rotatable about the axle, the axle having detent means comprising a multiplicity of sockets in the axle, the sockets spaced discretely from one another by a determinant length and aligned in a line that is parallel to said axis, each socket receiving therein a cammable detent and a means biasing the detent radially outwardly into a detent groove in the inner surface of a hub collar when the base wheel is rotated so as to bring said detent groove, and the axle having a retention means on each end thereof, the retention means comprising a lip disposed generally at a respective end of the aligned multiplicity of rotatable base wheels.

9. The puzzle of claim 8 wherein said rotatable base structures are rotatable base wheels, each base wheel including a cylindrical hub collar of determinable length, the hub collar having a hub inner surface which faces radially inwardly and in which a plurality of detent grooves are disposed parallel to and spaced concentrically about said axle and having an outer surface from which a plurality of planar spokes radiates and each base wheel including an outer collar to which said planar spokes radiate, the outer collar being disposed concentrically about the hub collar and the outer collar having a surface which faces radially outwardly, wherein said second part holding means is a plurality of mortise grooves disposed parallel to and concentrically about said axle, and wherein said first part holding means is a dovetail tenon projecting radially inwardly toward said axle, the dovetail tenon of each slide element being insertable into, retainable by, and slidable along a mortise groove of an outer collar and being slidable from a mortise groove of one outer collar to the mortise groove of another when the mortise groove of said one outer collar and the mortise groove of said another are aligned.

10. The puzzle of claim 7 wherein the indicia is a color graphic, the color graphic on the face of each slide element being generally different than the color graphic on the face of the slide elements of the plurality of slide elements and wherein all of the slide elements together are capable of displaying a representational shape that is other than a cylinder.

11. A self-contained puzzle embodied about an axis, the puzzle comprising:

a plurality of slide elements, some of said slide elements being thicker in cross-section than other of said slide elements, each including a face projecting outwardly from the axis so that the plurality of slide elements forms at least one mosaic geometric surface characterized by the absence of at least one element so as to leave a slot in one position on the surface into which one of the plurality of slide elements is slidable so as to leave a slot in another position on the surface and each slide element having first part retention means for cooperating with second part retention means;

a multiplicity of rotatable base structures aligned end to end to extend along and rotate about said axis, each base structure having second part retention means cooperative with said first part retention means for keeping the face of a respective slide element into registry with a said at least one surface and restricting said respective slide element so that said respective slide element is only capable of sliding into a slot in a direction parallel to the axis and each base structure having first part camming detent means for cooperating with second part camming detent means; and an axle extending along said axis, each of the rotatable base structures rotatable thereabout, the axle having second part camming detent means cooperative with said first part camming detent means for holding each rotatable base structure in a relative angular disposition with respect to other rotatable base structures, whereby the puzzle may be manipulated to change said at least one mosaic geometric surface by rotating base structures to axially align said slot with said one of the plurality of slide elements and by sliding said one of the plurality of slide elements into said slot.

12. The puzzle of claim 11 wherein the first part retention means is a dovetail tenon and the second part retention means is a mortise.

* * * * *